340-552
6/10/80 OR 4,207,560

United States Patent [19]
Poirier

[11] 4,207,560
[45] Jun. 10, 1980

[54] R F AREA INTRUDER DETECTION AND TRACKING SYSTEM

[75] Inventor: J. Leon Poirier, Chelmsford, Mass.

[73] Assignee: The United States of America as represented by the Secretary of the Air Force, Washington, D.C.

[21] Appl. No.: 936,160

[22] Filed: Aug. 23, 1978

[51] Int. Cl.[2] ..... G08B 13/24
[52] U.S. Cl. ..... 340/552; 340/525; 333/237; 343/771
[58] Field of Search ..... 340/552, 525, 524, 541, 340/24; 343/771; 333/237

[56] References Cited

U.S. PATENT DOCUMENTS

| | | | |
|---|---|---|---|
| 3,660,847 | 5/1972 | Danamer | 340/24 |
| 3,794,992 | 2/1974 | Gehman | 340/552 |
| 3,806,908 | 4/1974 | Bound et al. | 340/525 |
| 3,922,678 | 11/1975 | Frenkel | 340/24 |
| 4,135,185 | 1/1979 | Rotman et al. | 340/552 |

*Primary Examiner*—Glen R. Swann, III
*Attorney, Agent, or Firm*—Joseph E. Rusz; Sherman H. Goldman

[57] ABSTRACT

The detection, location and tracking of an intruder in an area to be protected is accomplished by dividing the area into a multiplicity of discrete regions, transmitting r.f. signals from transmitting transducers that comprise lengths of transmission lines deployed along the boundaries of the discrete regions, and receiving intrusion occurrence signals from receiving transducers located within each region. Violation of a boundary by an intruder results in an intrusion signal from the receiving transducers of as many as four possible adjacent regions thereby indicating an intrusion event. A coincidence logic circuit indicates which boundary has been violated. Intrusion occurrence signals are stored for suitable periods of time while past and current intrusion events are indicated on a display in order to locate and track intruders.

3 Claims, 7 Drawing Figures

○ TRANSMITTING SENSOR FEED POINTS

• RECEIVING ANTENNAS

FIG. 2A
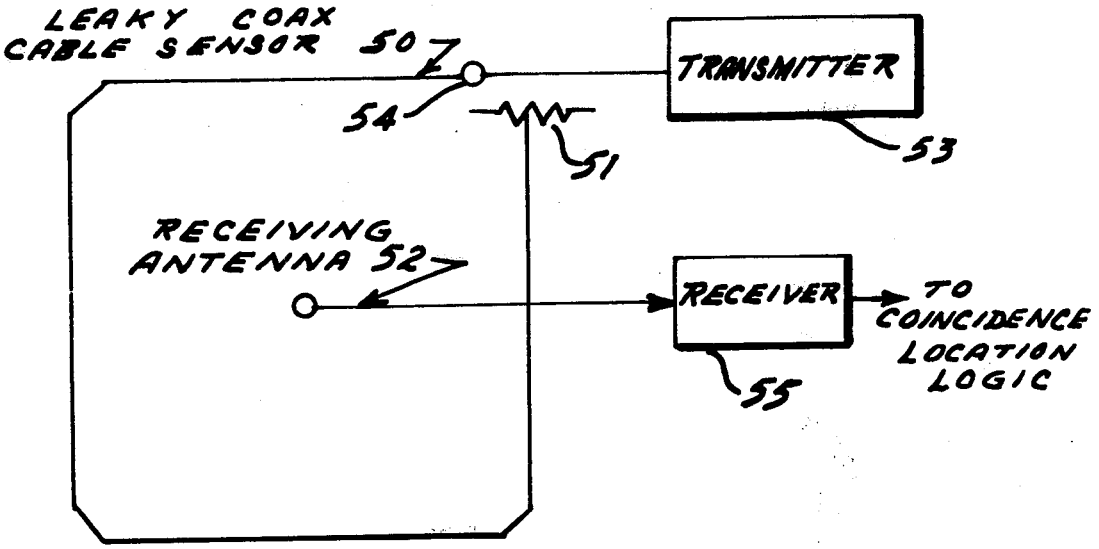
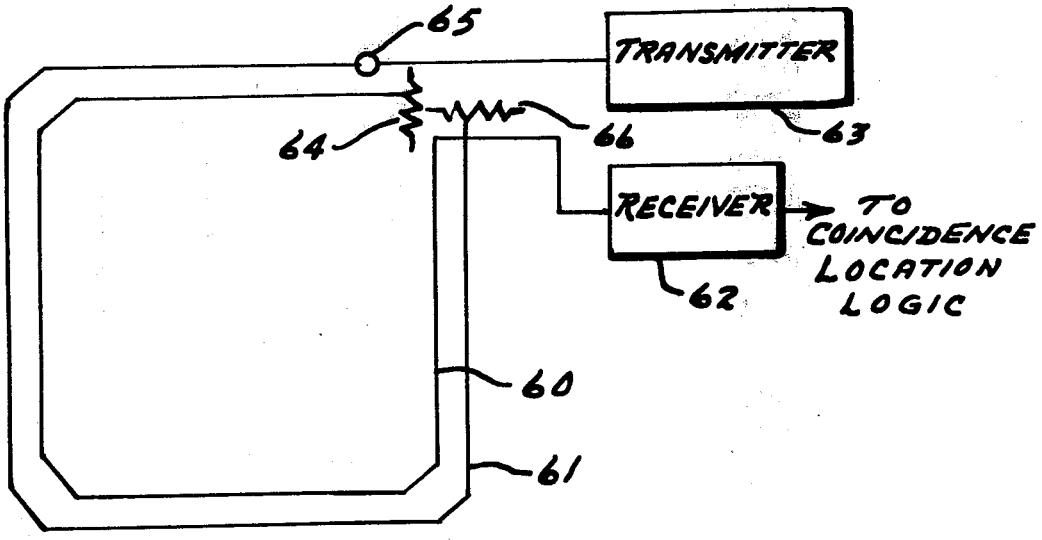
FIG. 2B

70
TRANSMITTER
DISTRIBUTION TO ALL SENSORS OF FIG. 1
10
RECEIVER
FROM SENSOR AA' OF FIG. 1
10a
DETECTOR
AGC
10b
BAND-PASS FILTER
10c
THRESHOLD DETECTOR
10d
ALARM SHAPER
AA' TO LOGIC AND DISPLAY
31
RECEIVER
FROM SENSOR EE' OF FIG. 1
31a
DETECTOR
AGC
31b
BAND-PASS FILTER
31c
THRESHOLD DETECTOR
31d
ALARM SHAPER
EE' TO LOGIC AND DISPLAY

92
DISPLAY
91
LED DRIVER
91a
LED DRIVER
91x
LED DRIVER
92
LATCH RESET
LATCH
90
LATCH
90a
90x
LATCH
89
COINCIDENCE LOCATION LOGIC OF FIG. 4
FROM AA' OF FIG. 1
FROM AB' OF FIG. 1
FROM EE' OF FIG. 1

R F AREA INTRUDER DETECTION AND TRACKING SYSTEM

STATEMENT OF GOVERNMENT INTEREST

The invention described herein may be manufactured and used by or for the Government for governmental purposes without the payment of any royalty thereon.

BACKGROUND OF THE INVENTION

The system of the present invention provides for the first time the ability to track an intruder after he has crossed a perimeter boundary. It uses a grid of leaky coaxial cables as sensors and provides location information by identifying the specific subboundary within the grid which was crossed with a coincidence location logic circuit. The system further provides a method of detecting and locating an intrusion not only across a perimeter boundary, but also within the boundary. No system now exists to track an intruder within the zone perimeter. It is noted this system can be used to provide a high level of security for a number of applications and installations such as aircraft parking ramps, material storage areas, and missile launch complexes, etc.

SUMMARY OF THE INVENTION

A system for R F area intruder detection and tracking is provided. The area to be protected is divided into a number of smaller cells. Certain cells may be omitted to allow for building or other terrain features. Each cell consists of a transmitting transducer and a receiving transducer. The presence of an intruder near the boundary of a cell causes the signal coupled from the transmitting to the receiving transducer to change. This changing signal is processed in the receiver to produce an "intruder present" output. All receiver outputs may be monitored in a coincidence location logic array which identifies the precise boundary which was crossed. These outputs may be supplied to a display board through a latch circuit which remembers the location of past intrusions, thus providing a visual track of the intruder.

DESCRIPTION OF THE DRAWINGS

FIGS. 2A and 2B each show a separate cell loop configuration,

DESCRIPTION OF THE PREFERRED EMBODIMENT

Figure 1:
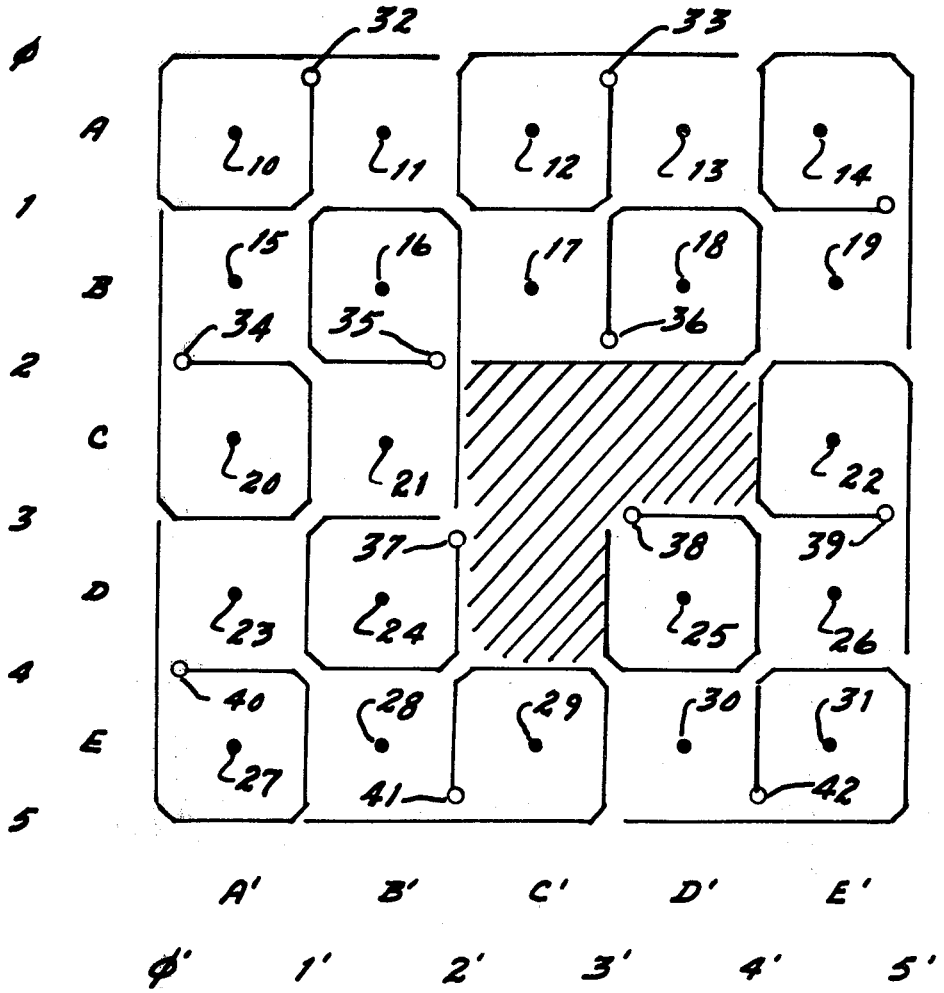
FIG. 1 shows a layout for a preferred system.

To clarify the preferred system, the rows and columns of the cell array are designated by numbers and letters as shown in FIG. 1. For example, receiving sensor BC′ is in the second row, third column. The boundary between sensor BC′ and BD′ is designated B3′ etc. Thus, an intrusion across the subboundary $\phi$C′ can only produce an output from sensor AC′. Similarly, an intrusion across B2′ will produce an output from both BB′ and BC′. Therefore, it is only necessary to test the signal changes from each of the receiving sensors for coincidence to identify the boundary which was crossed. It is noted there are shown receiving antennas 10–31 and transmitting sensor feedpoints 32–42.

Two transmitting-receiving transducers are shown in FIGS. 2A and 2B. In FIG. 2A, the transmitting transducer is a leaky coaxial cable loop which is terminated in matched load 51. The receiving transducer is centrally located antenna 52. There is also transmitter 53 connected to transmitting transducer feedpoint 54. Receiver 55 is connected to receiving antenna 52. The output from the receiver may be utilized in coincidence location logic. In FIG. 2B, the receiving transducer is replaced by leaky coaxial cable 60 parallel to and separated from the transmitting sensor which is leaky coaxial cable 61. Each of these configurations has certain advantages and other types and configurations are possible. It is further noted that receiver 62 is connected to leaky coaxial cable 60 which is terminated in matched load 64 and transmitter 63 is connected to feed point 65 and then to leaky coaxial cable 61 which is terminated by matched load 66.

Subsequent transmitting transducers can be fed from previous transducers by inserting line amplifiers and power dividers in place of the termination. Any number of interconnection plans can be formulated. The roles of the transmitting and receiving transducers can be interchanged, although using a leaky coaxial cable as the transmitting transducer in the system of FIG. 2A has the advantage of keeping the effective radiated energy low.

Figure 3:
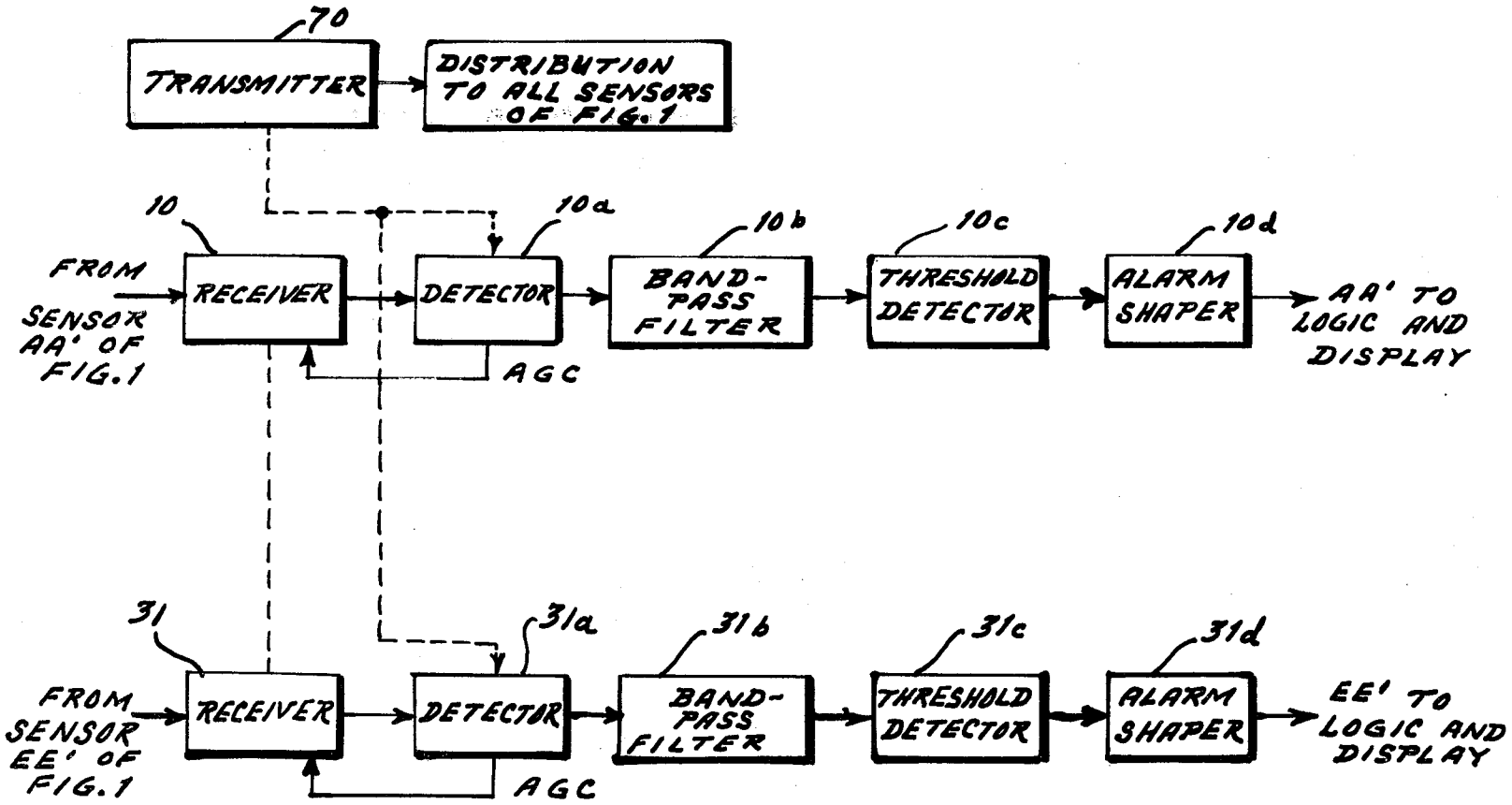
FIG. 3 shows the receiver transmitter block diagram.

The transmitter may be typically a low power CW solid state unit operating in the VHF range. The receiver may be any one of several types (crystal video, TRF, super heterodyne etc.) depending upon the size of the cells. Coherent detection and long time constant a g c may be of advantage to enhance rejection of interfering signals and reduce the effect of slow changes in ambient environmental conditions. A representative arrangement is shown in FIG. 3 in which transmitter 70 feeds all the transducers of FIG. 1, there is shown receivers 10 through 31 for FIG. 1 each one receiving a signal from antennas 10 through 31, respectively. Channel 10 through **10*d* is described, and it is also applicable to channel 31 through 31*d*. The signal from receiver 10 is fed to detector 10*a* which also receives a signal from transmitter 70. Detector 10*a* provides a g c for receiver 10. Bandpass filter 10*b* passes the output signal from detector 10*a* to threshold detector 10*c* for application to alarm shaper 10*d*** and then it is received by logic and display. The detector output is filtered to allow any changes which could be produced by human motion to be passed into the threshold detector. The alarm shaper is a retriggerable one-shot which is timed to assure the existence of an alarm signal for a sufficiently long time to complete coincidence testing.

Figure 4:
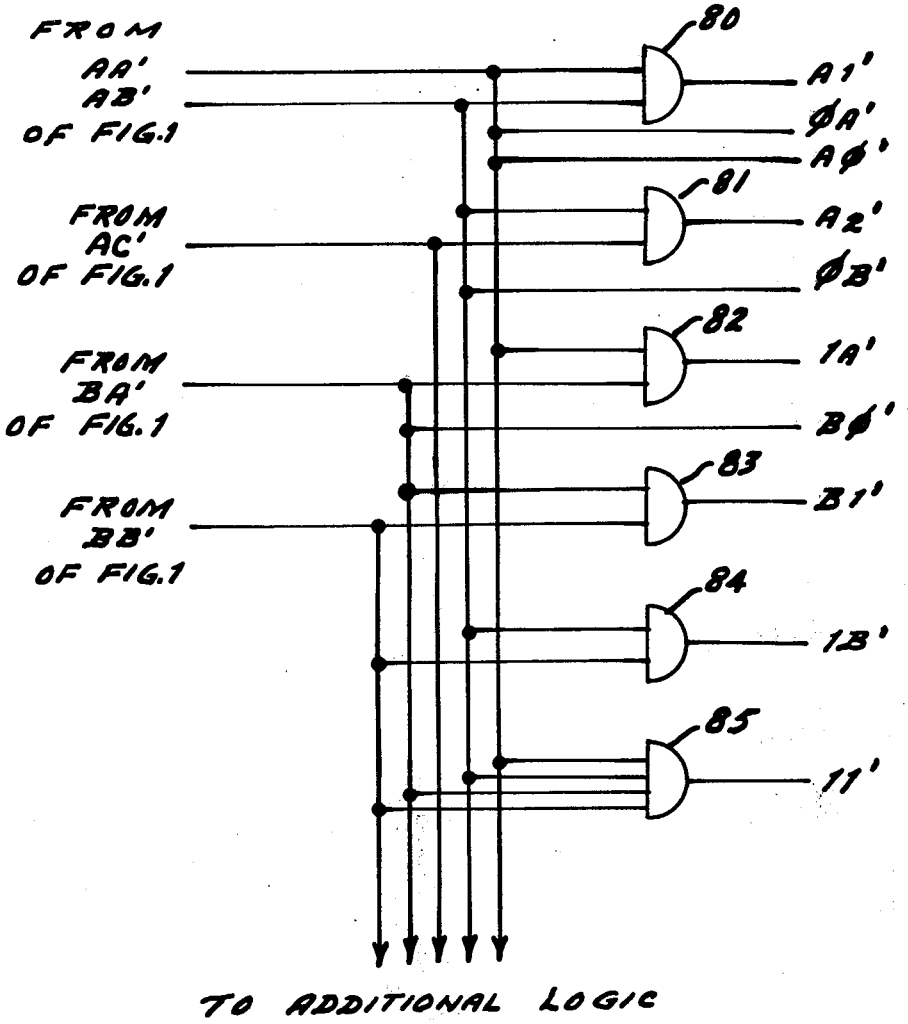
FIG. 4 shows the coincidence logic circuit.

An implementation of the coincidence location logic array for the cells in the upper left hand corner of FIG. 1 is shown in FIG. 4. An intruder can produce an alarm signal in up to four cells simultaneously, so it is necessary to test the outputs from each cell for coincidence with the output of another adjacent cell. Coincidence identifies the intruder location as that boundary common to the cells which display an output in their alarm outputs. AND gates 80–85 are illustrative and indicate the operation for some of the representative cells of FIG. 1.

Figure 5:
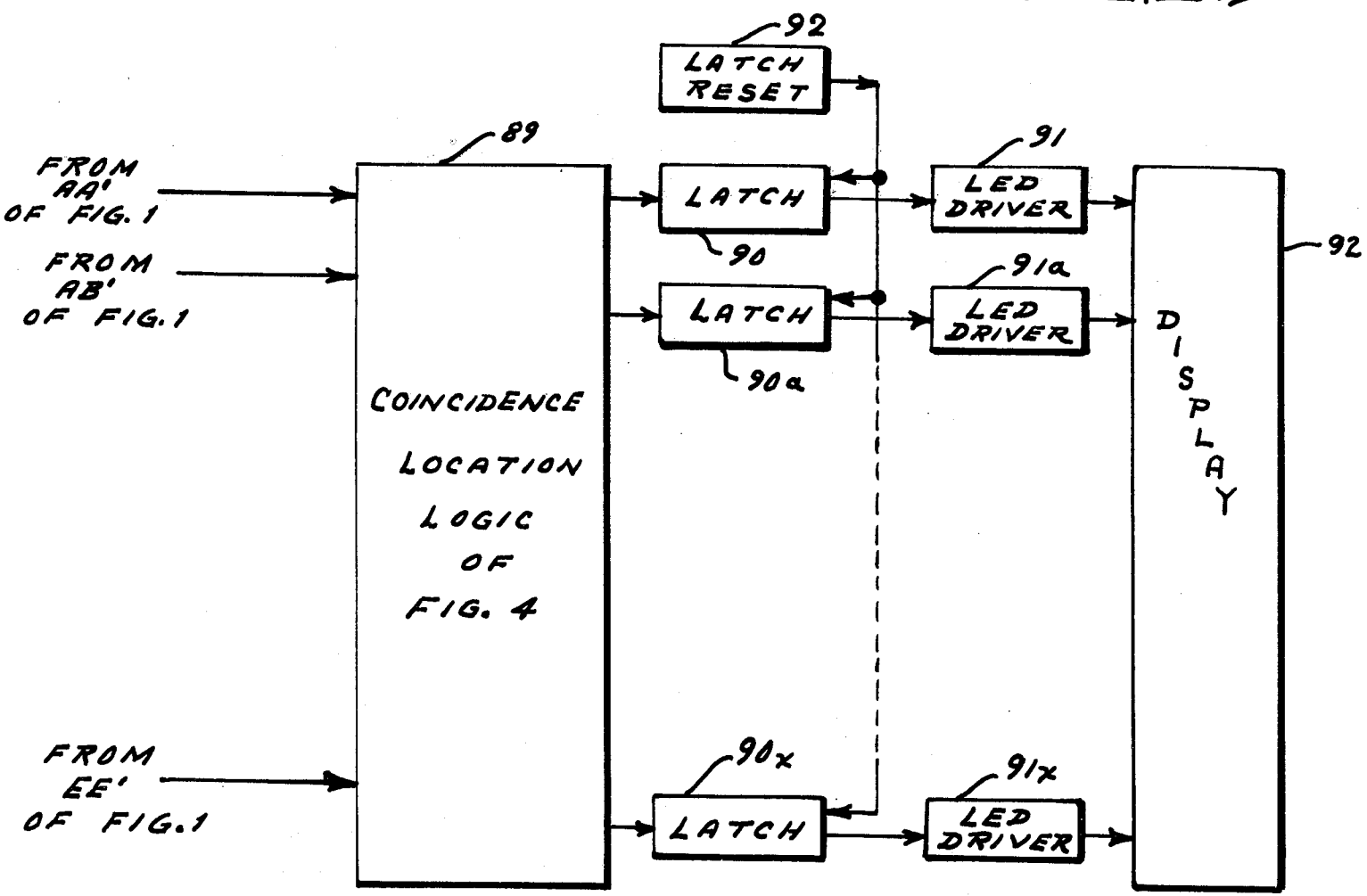
FIG. 5 shows a block diagram of the latch and display driver.

The outputs from the coincidence location logic, each corresponding to a cell subboundary, operate a latch which controls the display lamp driver. This arrangement is shown in FIG. 5. The latch is required to store the intrusion location after the intruder leaves that location. Each latch can be manually reset by an operator when required. The coincidence location logic of FIG. 4 is shown as component 89. It feeds latches 90 through 90*x*. Latch reset 92 is shown as available to latches 90 through 90*x*. Each of the latches possess an output to the respective drive. Drivers 91 through 91*x* are utilized for latches 90 through 90*x*, respectively. The outputs from drivers 91 through 91X may be fed to display 92.

Figure 6:
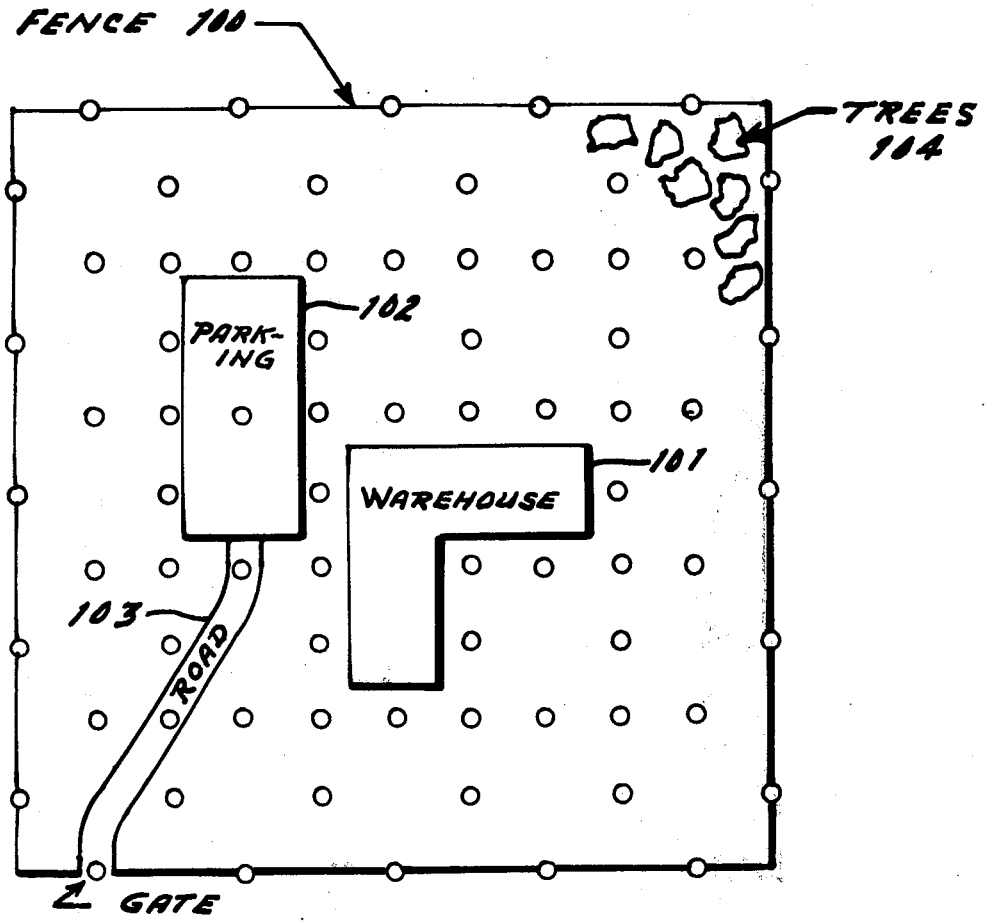
FIG. 6 shows a display board.

One type of display board is shown in FIG. 6 in which a set of LED indicators indicated by circles is superimposed on an outline map of the area to be protected which shows fence 100, warehouse 101, parking 102, road 103 and trees 104. Each output from the coincidence logic network controls one of the LED indicators and the latch keeps the indicator on once it is alarmed. As the intruder moves about another LED comes on to record his new location. An operator-initiated reset control extinguishes the LED indicators at the end of a track.

I claim:

1. An intrusion detection system for detecting and locating intrusion events in an area to be protected comprising a multiplicity of electromagnetic wave transmitting transducers deployed to cover the area to be protected with a pattern of discrete enclosed regions, said transmitting transducers being lengths of transmission line defining region boundaries, an electromagnetic wave transmitter feeding said transmitting transducers, an electromagnetic wave receiving transducer within each discrete region, a receiver connected to each receiving transducer, each said receiver generating an output signal in response to the violation by an intruding agent of any boundary defined by a transmitting transducer adjacent that receiver's receiving transducer, and a coincidence logic circuit receiving the outputs of said receivers and being adapted to develop an intrusion occurrence signal for each region boundary in response to the coincident outputs from adjacent receiving transducers.

2. An intrusion detection system as defined in claim 1 including a display of the area to be protected having intrusion occurrence indicators, said indicators being actuated in response to said intrusion occurance signals.

3. An intrusion detection system as defined in claim 2 including intrusion occurrence signal storage means for retaining intrusion occurrence and location information, said storage means receiving outputs from said coincidence logic circuit and feeding said intrusion occurrence indicators.

* * * * *